US009943205B2

(12) United States Patent
Letera

(10) Patent No.: US 9,943,205 B2
(45) Date of Patent: Apr. 17, 2018

(54) MULTI-FUNCTION SURFACE CLEANING APPARATUS

(71) Applicant: Kevin M. Letera, New Castle, PA (US)

(72) Inventor: Kevin M. Letera, New Castle, PA (US)

( * ) Notice: Subject to any disclaimer, the term of this patent is extended or adjusted under 35 U.S.C. 154(b) by 766 days.

(21) Appl. No.: 13/895,769

(22) Filed: May 16, 2013

(65) Prior Publication Data

US 2013/0306108 A1 Nov. 21, 2013

Related U.S. Application Data

(60) Provisional application No. 61/647,581, filed on May 16, 2012.

(51) Int. Cl.

| | |
|---|---|
| ***A47L 11/40*** | (2006.01) |
| ***A47L 11/34*** | (2006.01) |
| ***B08B 3/02*** | (2006.01) |

(52) U.S. Cl.

CPC ..... *A47L 11/34* (2013.01); *A47L 11/4044* (2013.01); *A47L 11/4088* (2013.01); *B08B 3/024* (2013.01); *B08B 3/026* (2013.01)

(58) Field of Classification Search

CPC .. A47L 11/34; A47L 11/4044; A47L 11/4088; B08B 3/024; B08B 3/026

USPC ..... 134/198

See application file for complete search history.

(56) References Cited

U.S. PATENT DOCUMENTS

| | | | | |
|---|---|---|---|---|
| 1,000,383 A * | 8/1911 | Drake | A47L 9/02 15/415.1 |
| 3,127,227 A * | 3/1964 | Edwards | A47L 9/246 439/195 |
| 4,864,680 A * | 9/1989 | Blase | A47L 7/0009 15/321 |
| 4,879,784 A | 11/1989 | Shero | |
| 4,984,328 A | 1/1991 | Berfield | |
| 5,157,805 A * | 10/1992 | Pinter | A47L 11/4044 15/321 |
| 5,898,970 A | 5/1999 | Straiton | |

(Continued)

FOREIGN PATENT DOCUMENTS

EP 1254724 A1 * 11/2002 ..... B05B 15/065

*Primary Examiner* — Michael E Barr
*Assistant Examiner* — Tinsae B Ayalew
(74) *Attorney, Agent, or Firm* — The Webb Law Firm

(57) ABSTRACT

A multi-function surface cleaning apparatus includes a cleaning containment enclosure including a top surface and a plurality of walls connected to form a chamber therebetween, wherein each wall has an inner surface, an outer surface, and a bottom surface, a delivery lance fluidly connected to the top surface of the cleaning containment enclosure, a vacuum suction hose fluidly connected to the top surface of the cleaning containment enclosure, a gun trigger fluidly connected to a proximal end of the delivery lance, and a water pressure line fluidly connected to the gun trigger. The cleaning containment enclosure may include four walls configured to form a diamond-shaped cleaning containment enclosure. The cleaning containment enclosure further may include a plurality of relief vents that extends from the inner surfaces of the walls of the cleaning containment enclosure therethrough to the outer surfaces of the walls of the cleaning containment enclosure.

14 Claims, 15 Drawing Sheets

(56) References Cited

U.S. PATENT DOCUMENTS

| | | | | |
|---|---|---|---|---|
| 6,038,946 | A * | 3/2000 | Jackson | B25B 23/0021 81/177.2 |
| 6,370,728 | B1 * | 4/2002 | Burns | A47L 11/201 15/320 |
| 6,453,506 | B1 | 9/2002 | Sumner | |
| 6,647,585 | B1 | 11/2003 | Robinson | |
| 7,694,382 | B2 | 4/2010 | Williams et al. | |
| 2001/0034922 | A1 * | 11/2001 | Ko | A47L 7/04 15/320 |
| 2007/0113368 | A1 * | 5/2007 | Alexander | A47L 11/03 15/321 |
| 2007/0151069 | A1 * | 7/2007 | Kothrade | A47L 11/34 15/322 |
| 2011/0108066 | A1 * | 5/2011 | Holtby | B08B 1/00 134/21 |

* cited by examiner

MULTI-FUNCTION SURFACE CLEANING APPARATUS

CROSS REFERENCE TO RELATED APPLICATION

This application claims priority to U.S. Provisional Application No. 61/647,581, filed May 16, 2012.

BACKGROUND OF THE INVENTION

Field of the Invention

The present invention generally relates to a cleaning apparatus, and more particularly, to a multi-function surface cleaning apparatus.

Description of Related Art

Typically, commercial cleaning apparatuses for the cleaning of carpet and hard surfaces include an elongated perpendicular tube-like handle which is attached to a cleaning head with a seal-creating perimeter. The cleaning head carries and directs external pressurized fluid against the cleaning head's striker plate or directs internal pressurized fluid down towards the intended surface to be cleaned in conjunction with wet-vacuum suction. Common cleaning head shapes are the triangle, cone, and rectangle. Other less common shapes include the oval, circle, and square.

Many of the current tile and grout cleaning apparatuses operate on a high-pressure water stream between 1,000 and 1,500 psi. A high-pressure water stream above 600 psi can damage aging and loose grout, as well as etch tile if the water jet nozzle is not properly positioned a safe distance, 5 inches or greater, away from the surface to be cleaned. A flatter jet nozzle may also be used to compensate for a closer distance. Grout is much more fragile than cement or concrete, requiring a low to midrange pressure stream to prevent damage of the intended surface. Operating a pressure generating machine, whether it be a truck-mounted or portable system, at extremely high psi can damage the water pump and seals very quickly, which can be very dangerous and costly. Operating a pressure generating machine in the 200 to 600 psi range is safer for the intended surface to be cleaned and much more efficient in terms of energy consumption, whether it is petroleum, electricity, or any other energy source.

The elongated perpendicular tube-like handle limits movement and creates a bi-directional back and forth cleaning motion which places the user behind the cleaning head. All current cleaning apparatuses are designed in such a way that they are only one-function, bi-directional tools regardless if the cleaning head is interchangeable with different shaped heads. The shape of the cleaning head perimeter does not determine the cleaning motion, but rather the positioning of the elongated tube-like handle. The size and shape of the cleaning head determines the effectiveness and concentration of the pressurized cleaning fluid.

Larger cleaning heads enclose more surface area, but reduce cleaning fluid pressure significantly. Many cleaning heads contain multiple pressure cleaning fluid nozzles to compensate for the larger cleaning area, but the pressure cleaning fluid is still further weakened as each additional nozzle is added. This is because there is only one pressure source to supply the pressurized cleaning fluid to multiple nozzles that are attached to the same internal pressure channel tube.

These cleaning apparatuses are connected to water pressure and vacuum suction generating machines. Whether they be truck-mounted or portable units, they all achieve similar desired functions with variations in quality. This method of cleaning has become the industry standard for professional cleaning companies.

Various apparatuses have been devised for cleaning hard and cushioned surfaces. None provide the cleaning effectiveness, mobility, versatility, micro-precision, efficient energy consumption, and chemical-free eco-friendly cleaning of tile, grout, carpet, and other hard and cushioned surfaces taught by this invention.

Examples of different devices are described in the following patent documents. U.S. Pat. No. 5,157,805, issued to Pinter on Oct. 27, 1992, teaches pressurized water being driven against a slanted back wall of an elongated vacuum head which directs the water towards the base of a carpeted surface. U.S. Pat. No. 5,898,970, issued to Straiton on May 4, 1999, uses a direct high-pressure water blast, 1,000 to 1,500 psi, onto hard surfaces removing foreign substances through a self-contained cleaning enclosure with suction, having non-swiveling axle wheels and bi-directional sliding capabilities. U.S. Pat. No. 4,984,328, issued to Berfield on Jan. 15, 1991, discloses a drip-cleaning attachment for use in association with a vacuum cleaner for carpets. U.S. Pat. No. 4,879,784 issued to Shero on Nov. 14, 1989, features a bi-directional jet wand with water pressure within close proximity to a vacuum port during manipulation of the wand upon a hard surface and having the jet centered between two walls to deter splashing during dispersion of solution. U.S. Patent Application Publication No. 2007/0151069 to Kothrade discloses a hard surface edge cleaning apparatus having a cleaning head and vacuum tube that functions as a wand. U.S. Pat. No. 6,647,585 issued to Robinson on Nov. 18, 2003, features a bi-directional jet wand with water being delivered downward from behind the back wall of the housing in a fan-shaped pattern. U.S. Pat. No. 6,453,506 issued to Sumner on Sep. 24, 2002, includes a bi-directional jet wand having an elongated member forming a passageway for transporting material removed from a carpet by the vacuum head and having a liquid spray nozzle located at the front and back of the vacuum head. U.S. Pat. No. 7,694,382 issued to Genteman, et al. on Apr. 13, 2010, features a bi-directional jet wand having a vacuum chamber with a fluid intake end and a fluid exhaust end having a coupling member defining a passageway having a plurality of inlet ports, which is releasable and secured to the coupling member by means of a mortise and tenon joint.

All of the mentioned patents provide fairly similar cleaning apparatus solutions that include limited bi-directional movement and no precise description of the positioning of the water pressure jet or water blast stream concentration during cleaning operation. The current focus of these apparatuses have been geared towards one-function designs that clean on a macro level, treating tile and grout as one surface.

SUMMARY OF THE INVENTION

In one embodiment, a multi-function surface cleaning apparatus is provided. The surface cleaning apparatus generally comprises a diamond-shaped cleaning containment enclosure including a top surface and a plurality of walls connected to form a chamber therebetween, wherein each wall has an inner surface, an outer surface, and a bottom surface configured to form a seal between the cleaning containment enclosure and a cleaning surface, a delivery member defining a passageway therethrough and fluidly connected with the chamber of the cleaning containment enclosure, a vacuum suction hose defining a passageway therethrough and fluidly connected with the chamber of the cleaning containment enclosure, and an actuating member fluidly connected to an end of the delivery member, wherein the actuating member is configured to control flow of fluid through the delivery member.

The plurality of walls may be configured to form a diamond-shaped cleaning containment enclosure. At least one of the plurality of walls may define a relief vent that extends from the inner surface of the wall of the cleaning containment enclosure therethrough to the outer surface of the wall of the cleaning containment enclosure. A delivery member port with a locking groove system may be provided; the delivery member port may define a passageway therethrough and may be configured to fluidly connect the delivery member with the chamber of the cleaning containment enclosure. The vacuum suction hose may be fluidly connected with the chamber of the cleaning containment enclosure via a suction port defining a passageway therethrough. The suction port may be integrally joined with the delivery member port. A stationary handle connected to the vacuum suction hose via a hose position ring may be provided. A burn preventative molding may be positioned around a circumferential surface of the delivery member. The actuating member may be a gun trigger and may include a quick connector configured to receive a water pressure line.

In another embodiment, a multi-function surface cleaning apparatus includes a diamond-shaped cleaning containment enclosure including a top surface and a plurality of walls connected to form a chamber therebetween, wherein each wall has an inner surface, an outer surface, and a bottom surface configured to form a seal between the cleaning containment enclosure and a cleaning surface, a delivery member defining a passageway therethrough and fluidly connected with the chamber of the cleaning containment enclosure, a vacuum suction hose defining a passageway therethrough and fluidly connected with the chamber of the cleaning containment enclosure, an actuating member fluidly connected to an end of the delivery member, wherein the actuating member is configured to control flow of fluid through the delivery member, and an attachment member including a rectangular-shaped body defining a chamber therebetween and an octagonal-shaped enclosure connected to a top surface of the rectangular-shaped body. The diamond-shaped cleaning containment enclosure is configured for insertion into the octagonal-shaped enclosure.

At least one of the plurality of walls may define a relief vent that extends from the inner surface of the wall of the diamond-shaped cleaning containment enclosure therethrough to the outer surface of the wall of the diamond-shaped cleaning containment enclosure. The octagonal-shaped enclosure may further define at least one relief vent that extends from an inner surface of the octagonal-shaped enclosure therethrough to an outer surface of the octagonal-shaped enclosure. The delivery member may be fluidly connected with the chamber of the cleaning containment enclosure using spring-loaded buttons positioned on an outer surface of a delivery member port that extends from the top surface of the cleaning containment enclosure. The vacuum suction hose may be fluidly connected with the chamber of the cleaning containment enclosure via a suction port defining a passageway therethrough. The delivery member port may define a passageway therethrough. The spring-loaded buttons may be biased in an outward direction from the outer surface of the delivery member port and extend through corresponding holes extending through a delivery member cap positioned on an end of the delivery member. The suction port may be integrally joined with the delivery member port. A stationary handle connected to the vacuum suction hose via a hose position ring may be provided. A burn preventative molding may be positioned around a circumferential surface of the delivery member. The actuating member may be a gun trigger including a quick connector configured to receive a water pressure line. The diamond-shaped cleaning containment enclosure may include two corresponding parts, wherein the two corresponding parts may be connected together via a joining member configured to slide over the suction port upon the corresponding parts being positioned together.

In another embodiment, a method for cleaning a surface with a multi-function surface cleaning apparatus as described hereinabove is provided. The method includes providing a multi-function surface cleaning apparatus, positioning a corner of a diamond-shaped cleaning containment enclosure along a reference line on a cleaning surface, forming a seal between the diamond-shaped cleaning containment enclosure and the cleaning surface, applying pressure to an actuating member of the multi-function surface cleaning apparatus to apply water pressure via a delivery member to the reference line on the cleaning surface, simultaneously applying suction to the reference line via the vacuum suction hose, and moving the apparatus along the reference line in a straight line of transportation. The method may include moving the cleaning surface apparatus laterally along a perpendicular reference line. The method may include rotating a stationary handle on the surface cleaning apparatus about a longitudinal axis to re-position the direction of transportation, thereby allowing the surface cleaning device to be transported along a new reference line. The surface cleaning apparatus may be rotated up to 360 degrees.

Further details and advantages will be understood from the following detailed description read in conjunction with the accompanying drawings.

DESCRIPTION OF THE PREFERRED EMBODIMENTS

Figure 1:
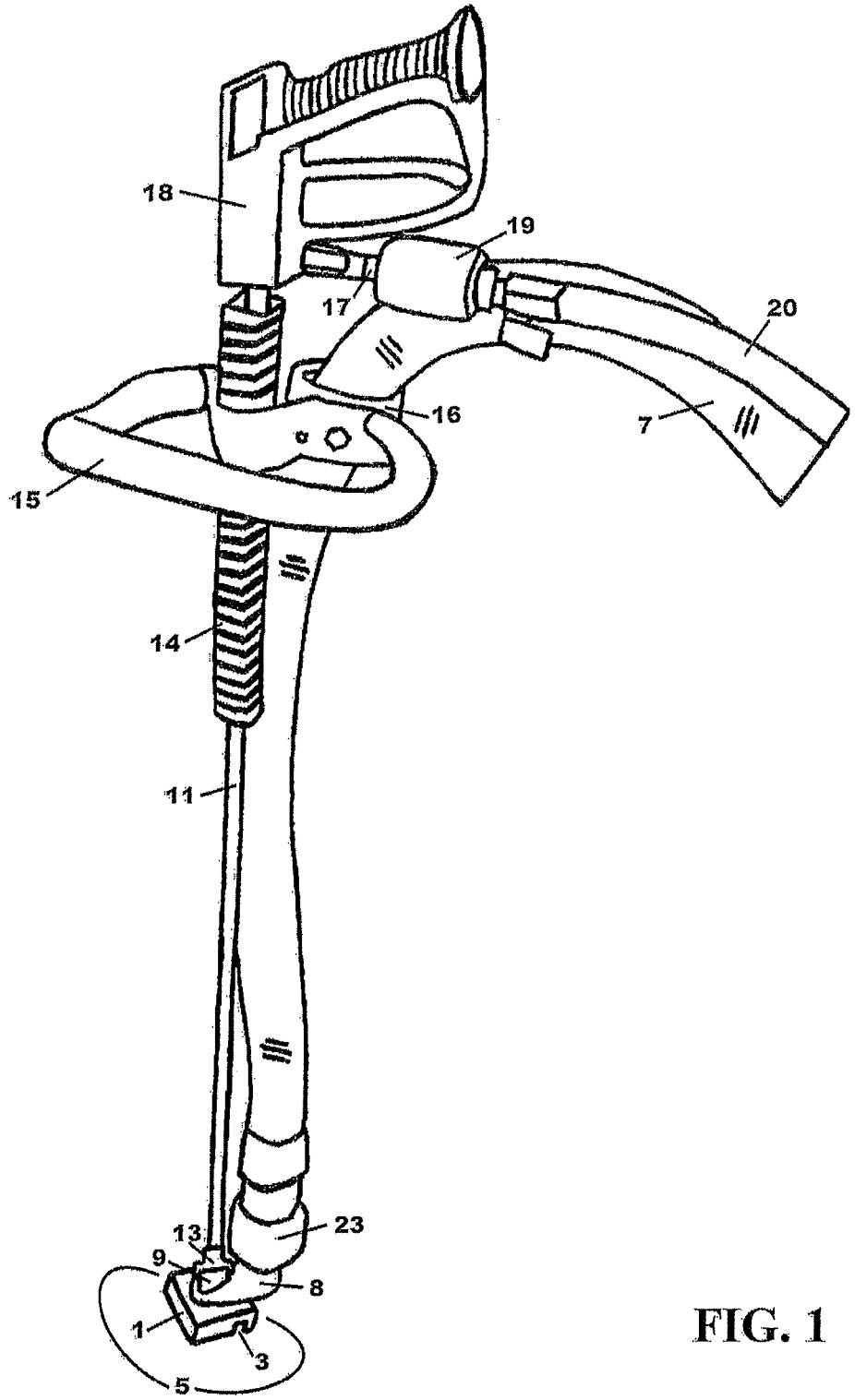
FIG. 1 is a side elevation view of one embodiment of the multi-function surface cleaning apparatus having an elongated water pressure delivery lance connected to a homogenous diamond-shaped perimeter wet-vacuum suction cleaning containment base in accordance with this disclosure.

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

Referring to FIGS. 1, 2, 9, & 10 a cleaning containment enclosure has a homogenous diamond-shaped perimeter 5 with a seal-creating base 4, which can create either a complete or partial seal. The intended surface to be cleaned forms a seal with the homogenous diamond-shaped perimeter 5 of the cleaning containment enclosure. A cylindrical water pressure delivery acceptation tube port 9 protrudes vertically. An elongated water pressure delivery lance 11 is inserted into the cylindrical water pressure delivery acceptation tube port 9 that is centered in the homogenous diamond-shaped perimeter 5 and held securely in place by a water pressure delivery lance acceptation cap with grooved interlocking system 13. The elongated water pressure delivery lance 11 may also be inserted into the cylindrical water pressure delivery acceptation tube port 9 by using a dome-shaped lance acceptation tube port cap 28 with a spring-like button tension locking system 24 and a supportive hand grip 29. A plurality of spring-like buttons 24 are positioned on an outer surface of cylindrical water pressure delivery acceptation tube port 9 and are biased in an outward direction from the cylindrical water pressure delivery acceptation tube port 9. The dome-shaped lance acceptation tube port cap 28 includes spring-like button acceptation holes 27 that extend therethrough for accepting the spring-like buttons 24. When the dome-shaped lance acceptation tube port cap 28 is slid over the cylindrical water pressure delivery acceptation tube port 9, the spring-like buttons 24 snap into and through the spring-like button acceptation holes 27 on the dome-shaped lance acceptation tube port cap 28. This effectively locks the water pressure delivery lance 11 in place. The water pressure delivery lance acceptation cap with grooved interlocking system 13 and/or dome-shaped lance acceptation tube port cap 28 is securely attached to the elongated water pressure delivery lance 11 which is a specified distance, 0.5 to 1.0 inch, from the surface to be cleaned. A hexagon-shaped lining 30 prevents torsion of the dome-shaped lance acceptation tube port cap 28 and the diamond-shaped perimeter 5 during operation.

Figure 3:
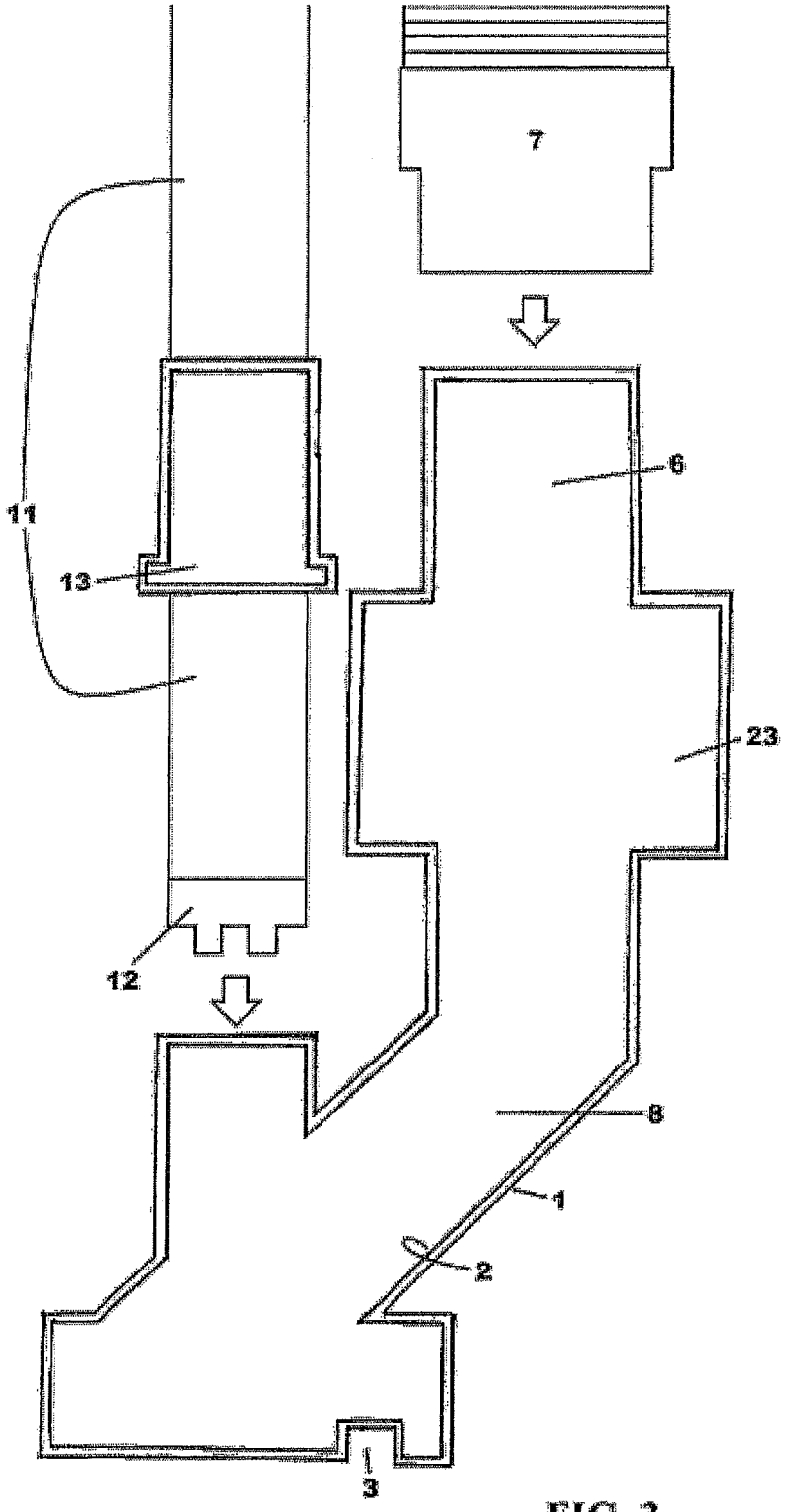
FIG. 3 is an internal side elevation view of the wall structure of the cleaning head of FIG. 2 ready to accept the water pressure delivery lance and wet-vacuum suction hose.

The apparatus provides a point-blank, micro-precise, concentrated low to midrange, water pressure cleaning stream, operating at 200 to 600 psi. This enables eco-friendly, chemical-free cleaning and efficient energy consumption of the pressure generating machine (not shown). An adjacent tapered cylindrical suction chamber 8 conjoins with the cylindrical water pressure delivery acceptation tube port 9 and an elongated water pressure delivery lance support 23 forming a complete vacuum chamber. As shown in FIG. 3, the tapered cylindrical suction chamber 8 and the cylindrical water pressure delivery acceptation tube port 9 may be formed together to define an opening before connecting to the cleaning containment enclosure. A flexible wet-vacuum suction hose 7 attaches to the complete vacuum chamber 8, 9, 23 in conjunction with a wet-vacuum (not shown) to remove common and atypical material from the cleaning enclosure during the cleaning of hard and cushioned surfaces. Blasted water and dirt are suctioned through the complete vacuum chamber 8, 9, 23, which then enters into the flexible wet-vacuum suction hose 7 and proceeds to a liquid recovery tank (not shown) of a truck-mounted or portable cleaning extractor. Suction of the cleaning containment enclosure to the intended surface is created by a greater absolute vacuum pressure per surface area of the wet-vacuum than positive low to midrange water pressure emerging from the nozzle of the elongated water pressure delivery lance 11. A burn preventative molding 14 and/or a supportive hand grip 29 for the elongated water pressure delivery lance 11 protects the user from high temperature cleaning fluid heat generation and/or serves as a mounting base for the stationary handle 15. Attached to the stationary handle 15 and/or the burn preventative molding 14 is a wet-vacuum suction hose position control ring 16 to direct the flexible wet-vacuum suction hose 7 to the complete vacuum chamber 8, 9, 23. A water pressure line 20 is attached to a water pressure gun trigger 18 via water pressure line acceptation nipple 17 and water pressure line quick connector 19. Low to midrange pressure water, 200 to 600 psi, is delivered through the elongated water pressure delivery lance 11 in a concentrated stream. The user may optionally choose to use the elongated water pressure delivery lance 11, jet nozzle 12, burn preventative molding 14, stationary handle 15, water pressure hose position control ring 16, water pressure gun trigger 18, and water pressure line acceptation nipple 17 when connected to a water pressure line 20 via water pressure line quick connector 19 separately as a pressure washing gun. In this state, this invention has cubic 360 degree rotation.

Figure 2:
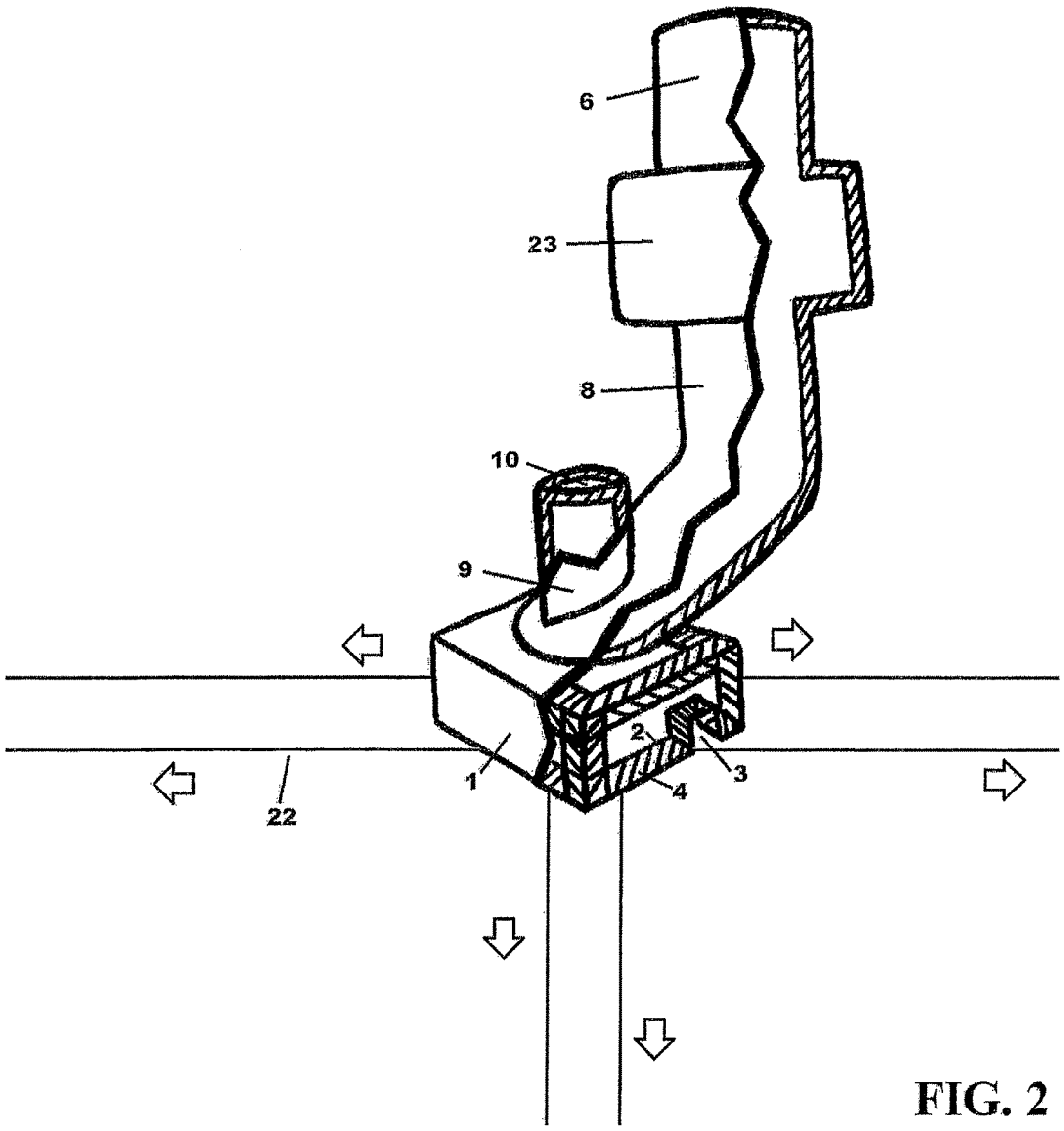
FIG. 2 is a partially cutaway side elevation view of the homogenous diamond-shaped cleaning head with cylindrical ports to accept the water pressure delivery lance and wet-vacuum suction hose as shown in FIG. 1.
Figure 9:
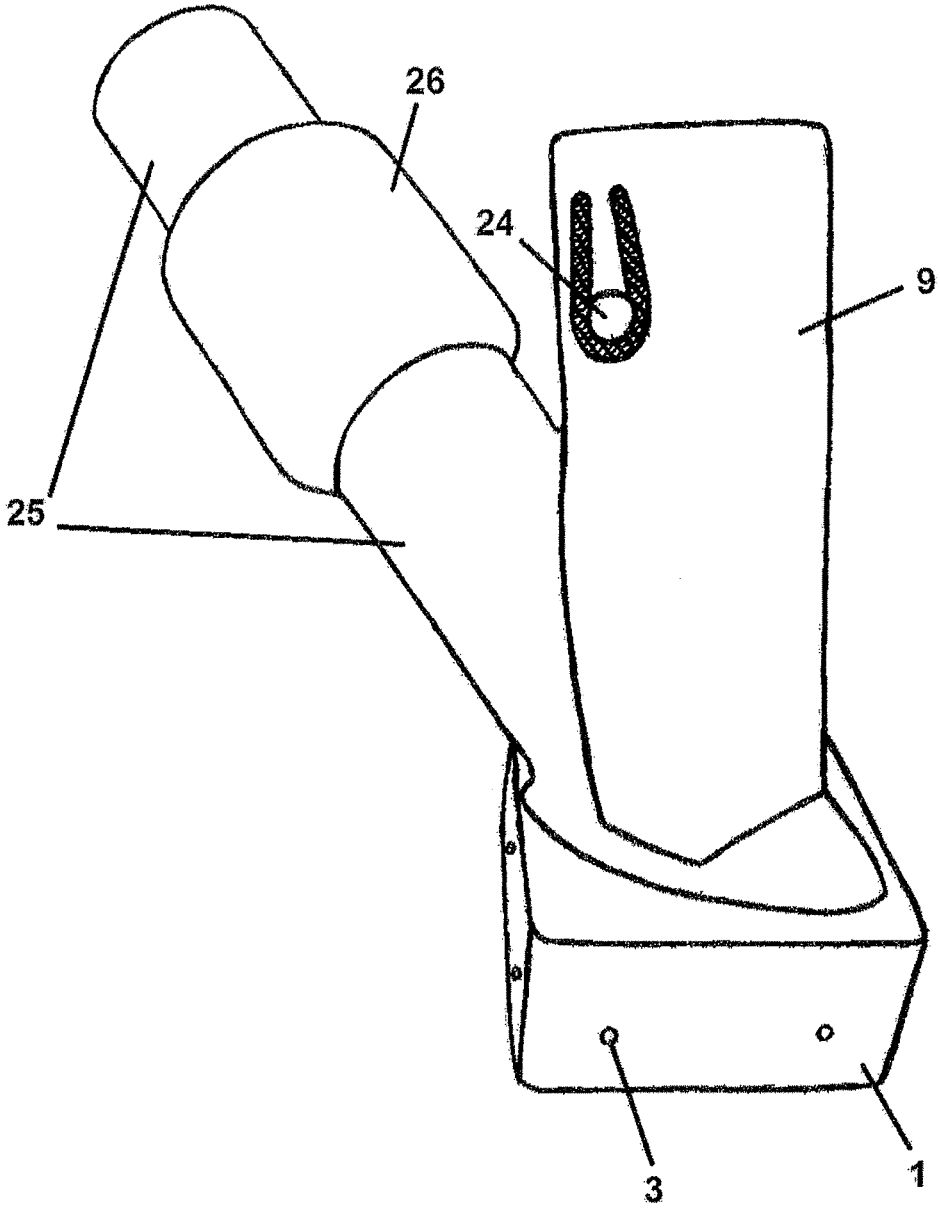
FIG. 9 is a side elevation view of another embodiment of the primary component having a homogenous diamond-shaped cleaning head, spring-like button tension locking system, and cylindrical ports to accept the water pressure delivery lance and wet-vacuum suction hose.

Referring to FIGS. 2 & 9, the present invention also includes a cleaning containment enclosure with an outer wall structure 1, an inner wall structure 2, and permanent nonadjustable air flow suction relief vents 3. The seal-creating base 4 combined with the homogeneous diamond-shaped perimeter 5 creates a pointed quad-direction guidance system for easy and precise cleaning along any reference line 22. This reference line 22 may be, among others, a grout line or a crack between adjacent panels. A cylindrical water pressure delivery acceptation tube port 9 with locking groove system 10 or, in the alternative, a spring-like button tension system 24 is centered upon the homogenous diamond-shaped perimeter 5. By centering any two opposite points of the homogenous diamond-shaped perimeter 5 on a reference line 22, a micro-precise concentration of a water pressure stream can be used at all times during operation. A tapered cylindrical suction chamber 8 increases suction as it approaches and conjoins with the cylindrical water pressure delivery lance acceptation tube port 9. An elongated water pressure delivery lance support 23 and cylindrical hose attachment tube 6 also conjoin with the tapered cylindrical suction chamber 8.

Referring to FIG. 3, an elongated water pressure delivery lance 11 having a water pressure delivery lance acceptation cap with grooved interlocking system 13 and jet nozzle 12 is inserted into a one-piece unit containing a cylindrical water pressure delivery lance acceptation tube port 9, a tapered cylindrical suction chamber 8, an elongated water pressure delivery lance support 23, and a cylindrical hose attachment tube 6. The unit also contains an outer wall structure 1 and an inner wall structure 2 with permanent nonadjustable air flow suction relief vents 3 in the perimeter of the base which creates a seal with the surface to be cleaned. A flexible wet-vacuum suction hose 7 is in an unengaged position with the cylindrical hose attachment tube 6.

Figure 4:
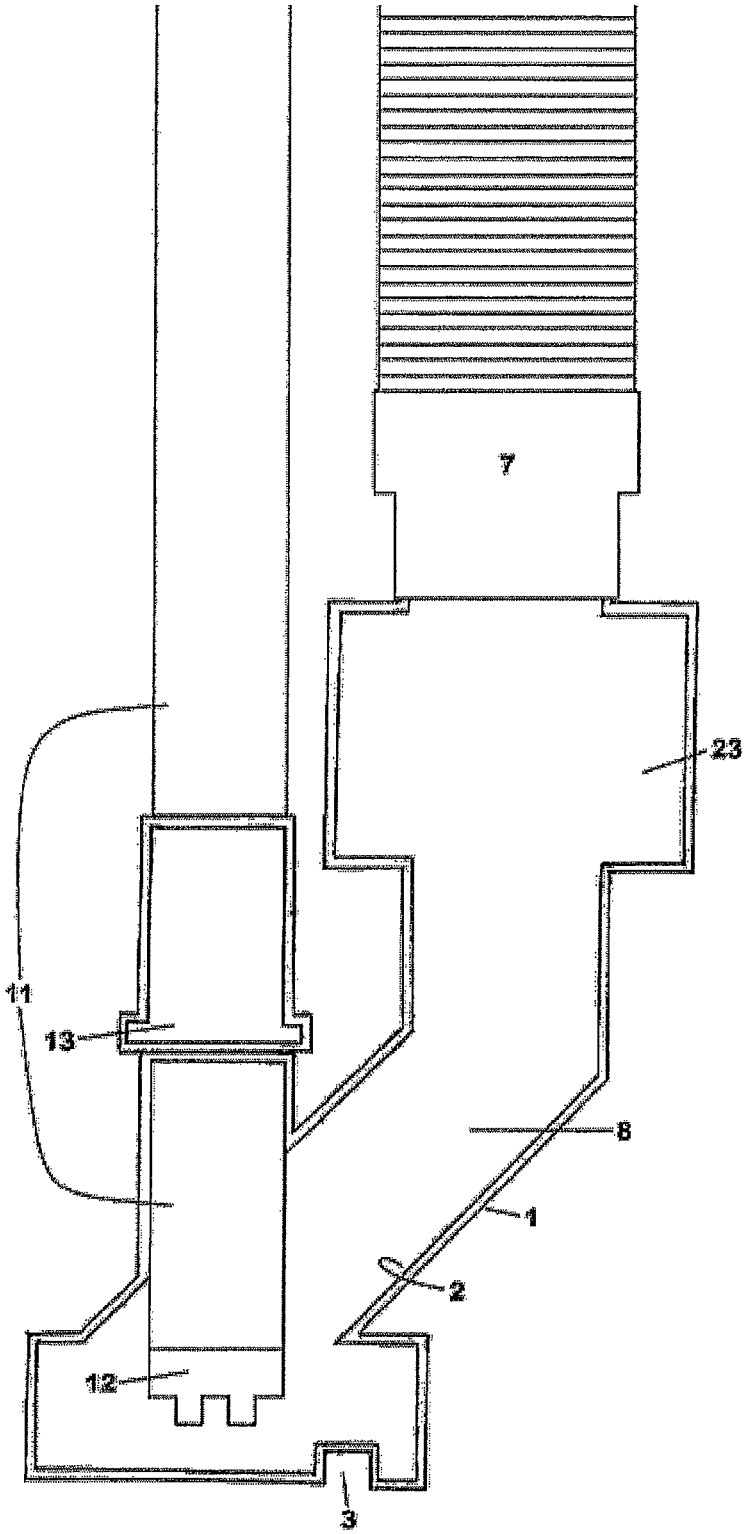
FIG. 4 is an internal side elevation view of the wall structure of the cleaning head of FIG. 2 after it has accepted the water pressure delivery lance and wet-vacuum suction hose.

Referring to FIGS. 3-4, an elongated water pressure delivery lance 11 having a water pressure delivery lance acceptation cap with grooved interlocking system 13 and jet nozzle 12 has been connected to a one-piece unit containing a cylindrical water pressure delivery lance acceptation tube port 9, a tapered cylindrical suction chamber 8, and an elongated water pressure delivery lance support 23. The unit also contains an outer wall structure 1 and an inner wall structure 2 with permanent nonadjustable air flow suction relief vents 3 in the perimeter of the homogenous diamond-shaped base which creates a seal with the surface to be cleaned. A flexible wet-vacuum suction hose 7 has been connected to the complete vacuum chamber.

Figure 5:
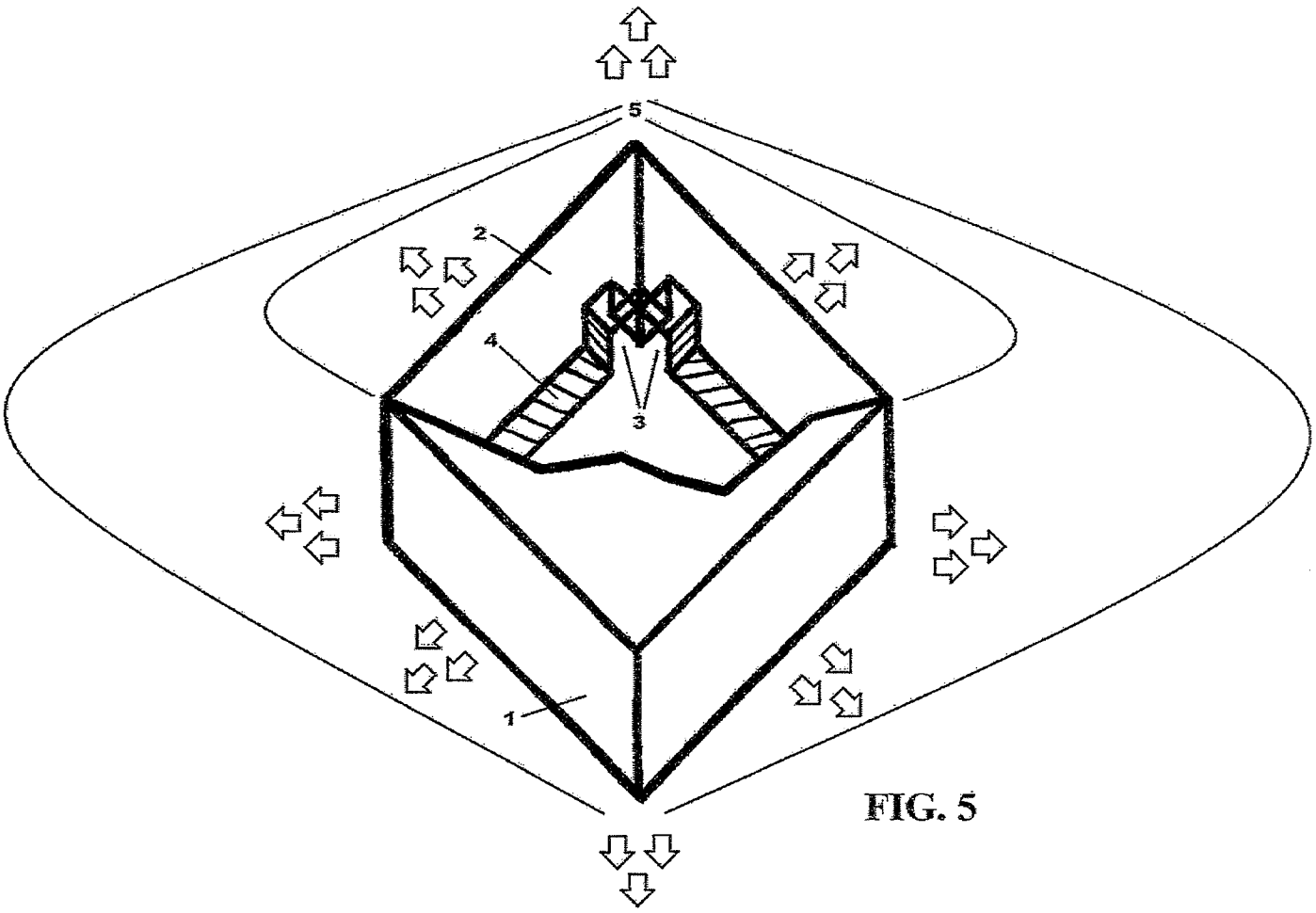
FIG. 5 is a partially cutaway front view of the homogenous diamond-shaped perimeter of the cleaning head of FIG. 1, its compass rose directional operational movement, and permanent nonadjustable air flow suction relief vents.

Referring to FIG. 5, a cleaning containment enclosure with an outer wall structure 1, inner wall structure 2, partial seal-creating base 4, permanent nonadjustable air flow suction relief vents 3, and homogenous diamond-shaped perimeter 5 permit the multi-directional compass rose maneuverability taught by this apparatus. Compass rose directional movement is recognized as: North, North-East, East, South-East, South, South-West, West, North-West, or any direction within a 360 degree radius.

Figure 6:
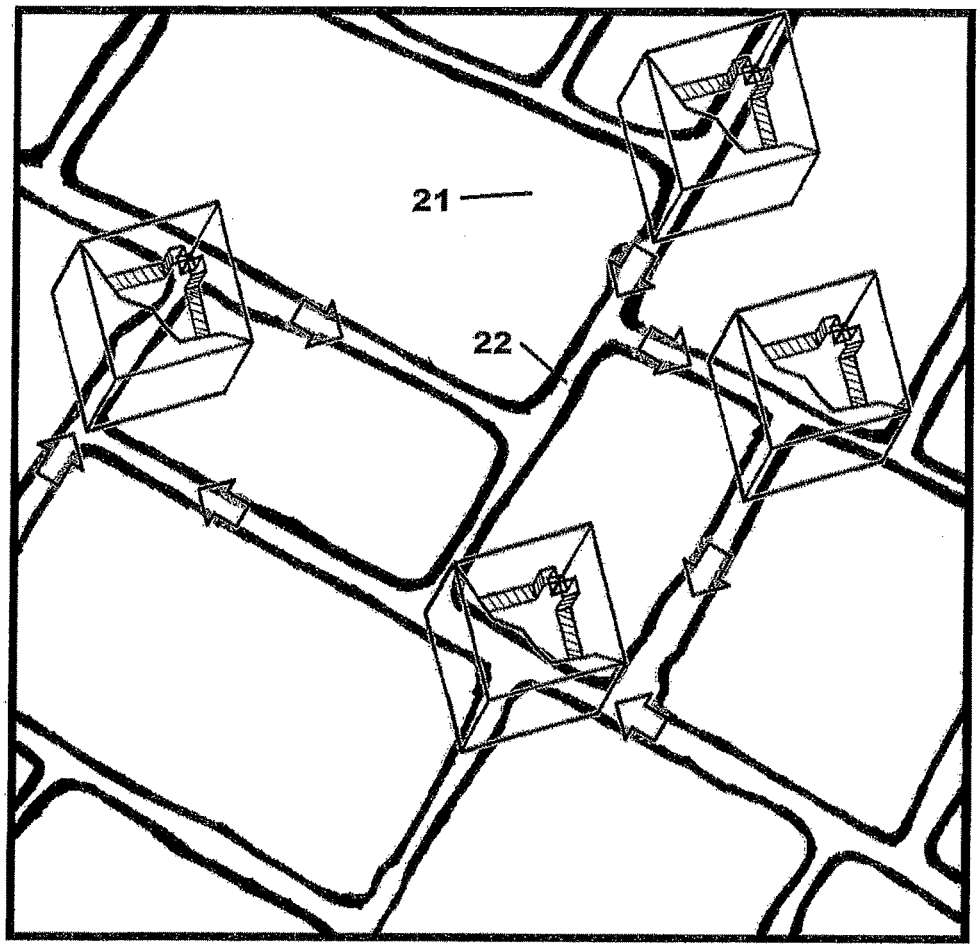
FIG. 6 is a partially cutaway front view of multiple homogenous diamond-shaped perimeters of the cleaning head and their maneuverability along heterogeneous grout lines.

Referring to FIG. 6, the compass rose maneuverability of FIG. 5 along heterogeneous and homogenous reference lines 22 is demonstrated. The user can clean reference lines 22 in any direction without a single rotation of the apparatus.

Figure 7:
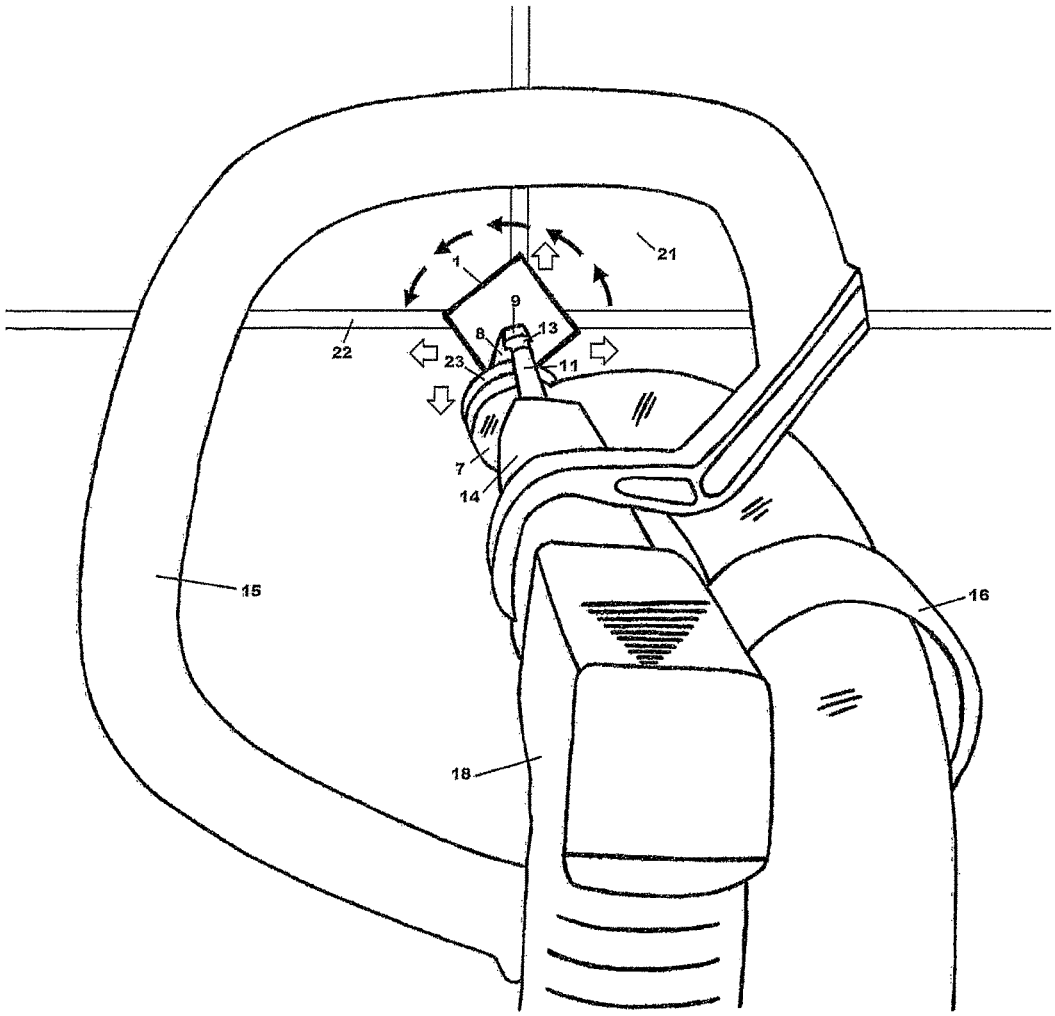
FIG. 7 is a top elevation view of the multi-function surface cleaning apparatus of FIG. 1 demonstrating compass rose directional movement along grout lines and the 180 degree rotation made possible by user placement above the cleaning head.

Referring to FIG. 7, a top view of the surface to be cleaned from the user's viewpoint is demonstrated. Placing the user above the surface cleaning apparatus demonstrates new compass rose maneuverability that creates a micro-precise, quad-directional arrow guidance system, possible only in conjunction with a homogenous diamond-shaped perimeter. This shape is also necessary for cleaning in corners. It also teaches radical new 180 degree rotation. The wet-vacuum hose position control ring 16 directs excess hose away from the user, but does not restrict the 180 degree rotation of the apparatus.

Figure 8:
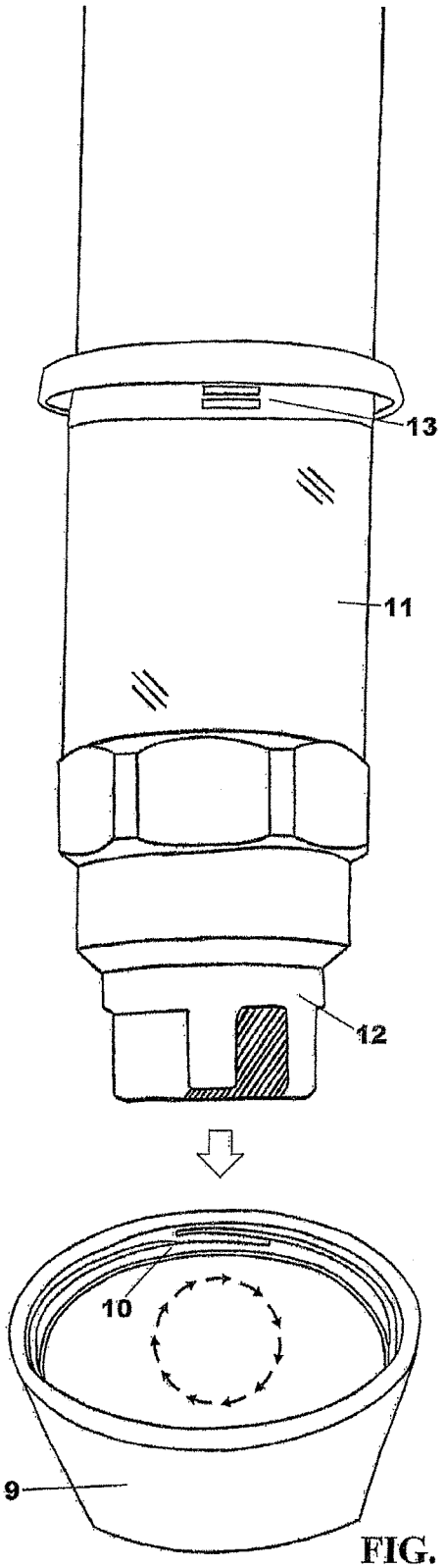
FIG. 8 is a side elevation view of the water pressure delivery lance of FIGS. 3 and 4 being inserted and secured by an integrated locking groove system to the cylindrical water pressure delivery lance acceptation tube.

Referring to FIG. 8, a close-up view of an elongated water pressure delivery lance 11, water pressure delivery lance acceptation cap with grooved interlocking system 13, and jet nozzle 12 is inserted into the cylindrical water pressure delivery lance acceptation tube port 9 with locking groove system 10. The water pressure delivery lance acceptation cap with grooved interlocking system 13 is secured to the cylindrical water pressure delivery lance acceptation tube port 9 by rotating the elongated water pressure delivery lance 11 clockwise or counterclockwise depending on the manufacture of the locking groove system 10. It is also disconnected by rotating the elongated water pressure delivery lance 11 in an opposite direction.

Referring to FIG. 9, another embodiment includes a cleaning containment enclosure with an outer wall structure 1, an inner wall structure, and permanent nonadjustable air flow suction relief vents 3. The seal-creating base combined with a homogeneous diamond-shaped perimeter 5 creates a pointed quad-directional guidance system for easy and precise cleaning along any reference line 22. A cylindrical water pressure delivery acceptation tube port 9 with spring-like button tension system 24 is centered upon the homogenous diamond-shaped perimeter. By centering any two opposite points of the homogenous diamond-shaped perimeter on a reference line 22, a micro-precise concentration of a water pressure stream is supplied at all times during operation. A cylindrical tube joiner 26 creates a temporary bond that joins the uniform cylindrical suction chamber 25 into one piece. The uniform cylindrical suction chamber 25 approaches and conjoins with the cylindrical water pressure delivery lance acceptation tube port 9, which also conjoins with the homogeneous diamond-shaped perimeter 5.

Figure 10:
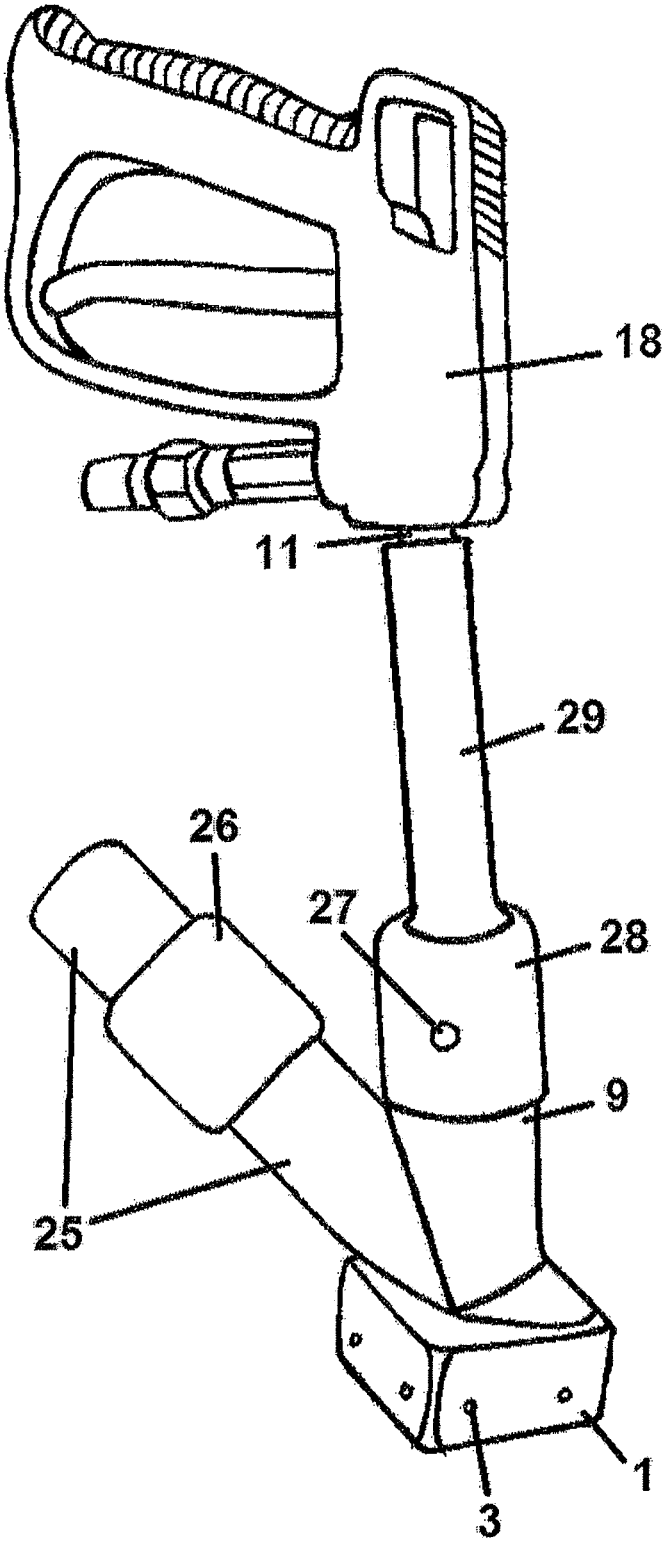
FIG. 10 is a side elevation view of a handheld variation of another embodiment of the multi-function surface cleaning apparatus having an elongated water pressure delivery lance with hand grip and connected to a homogenous diamond-shaped perimeter wet-vacuum suction cleaning containment base.

Referring to FIG. 10, the present invention also includes spring-like button acceptation holes 27 that ensure correct positioning of the dome-shaped lance acceptation tube port cap 28 with a supportive hand grip 29 and elongated water pressure delivery lance 11 every time.

Figure 11:
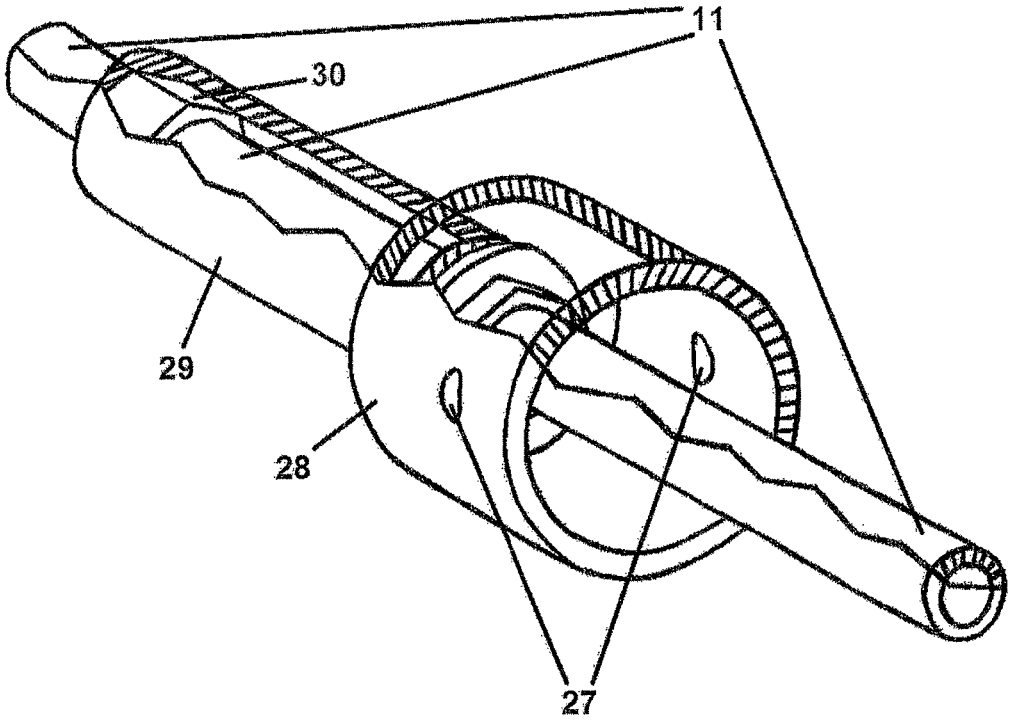
FIG. 11 is a partially cutaway side elevation view of the dome-shaped lance acceptation tube port cap encapsulating the water pressure delivery lance of FIG. 10.

Referring to FIG. 11, the present invention also includes an outer wall structure, an inner wall structure, and a hexagon-shaped lining 30 that prevents torsion of the dome-shaped lance acceptation tube port cap 28 and the diamond-shaped perimeter 5 during operation.

Figure 13:
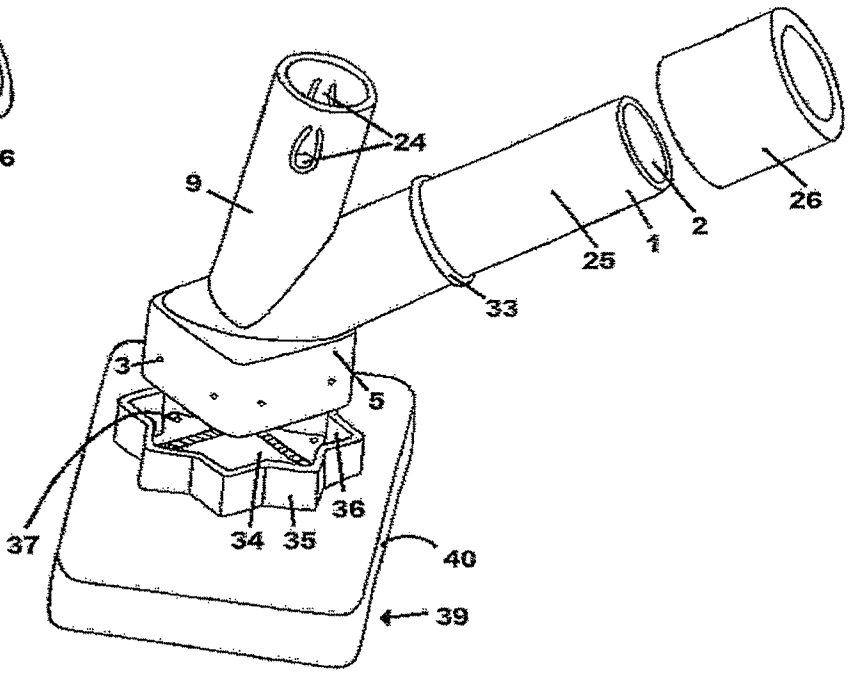
FIG. 13 is a side elevation view of the primary unit of FIG. 10 receiving the cylindrical tube joiner which is stopped by the bushing.
Figure 12:
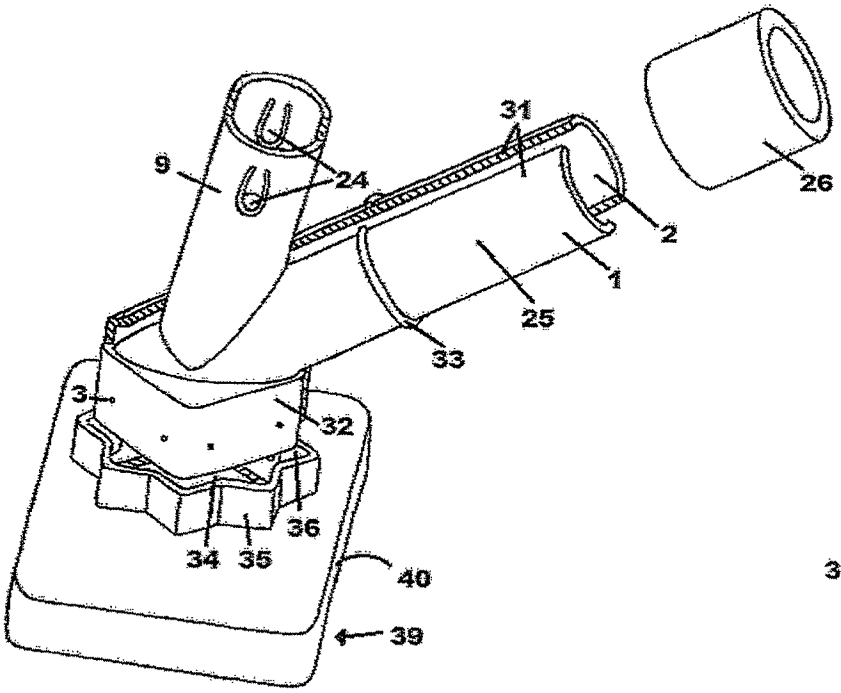
FIG. 12 is a side elevation view of the primary two-piece unit of FIG. 10 snapping together and awaiting reception of the cylindrical tube joiner which will be stopped by the bushing.
Figure 14:
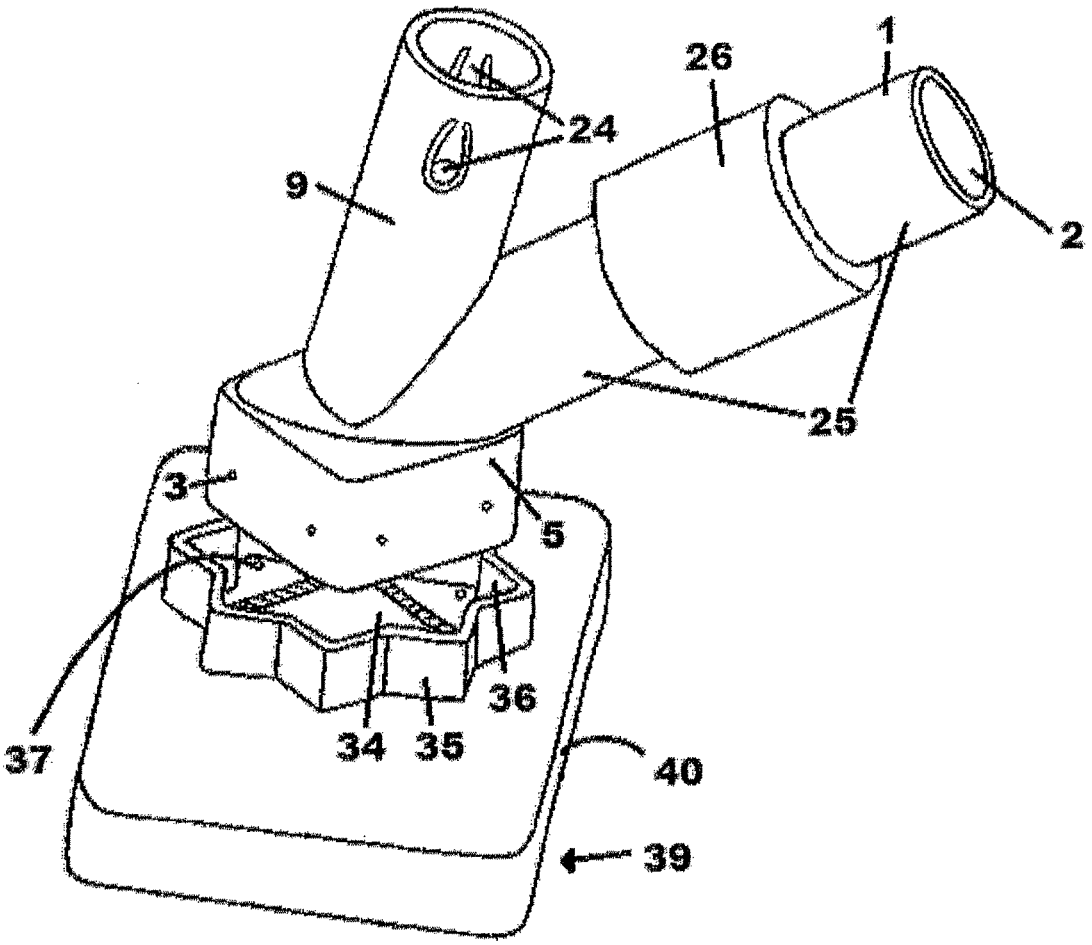
FIG. 14 is a side elevation view of the primary unit of FIG. 10 after bonding and reception of the cylindrical tube joiner that has been stopped by the bushing.
Figure 16:
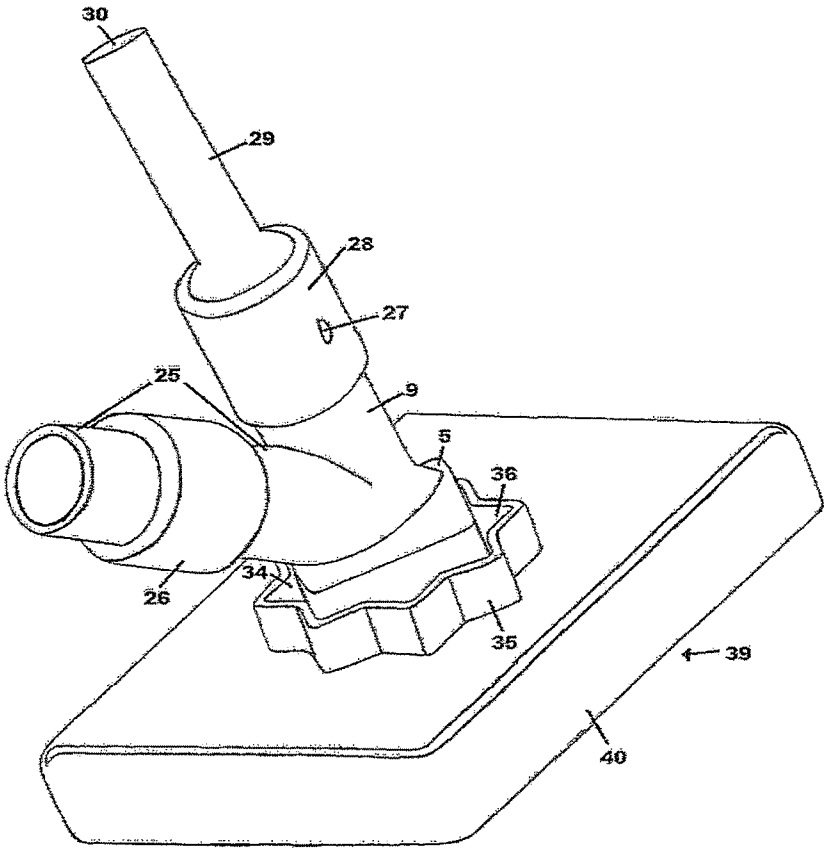
FIG. 16 is a rear side elevation view of the completed rectangular enclosure that also contains the octagonal enclosure after an alternate insertion of the primary unit; the alternate insertion reconfigures the rectangular enclosure differently than FIG. 15.
Figure 15:
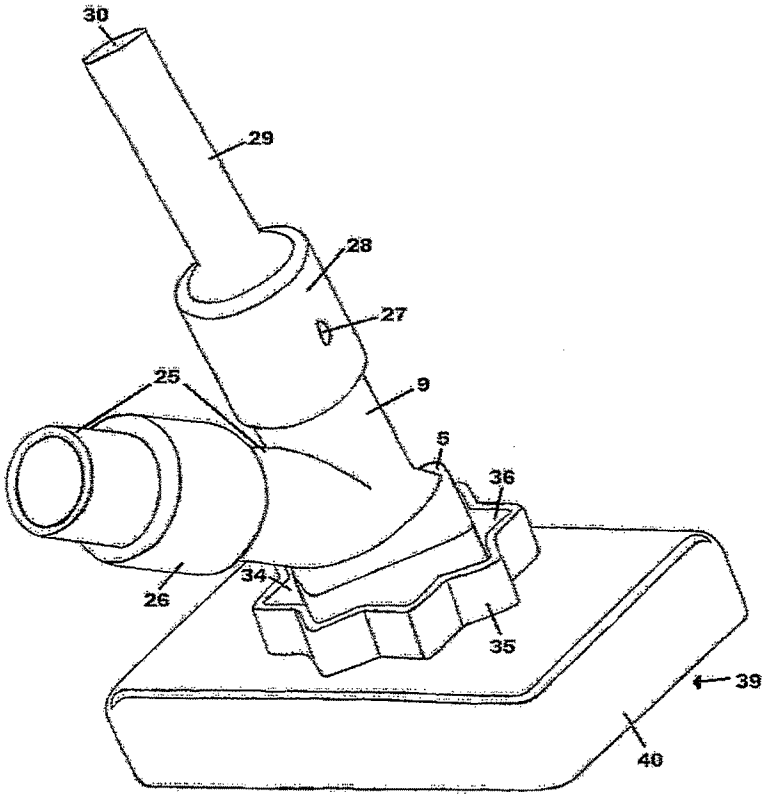
FIG. 15 is a rear side elevation view of the completed rectangular enclosure that also contains the octagonal enclosure after insertion of the primary unit.
Figure 18:
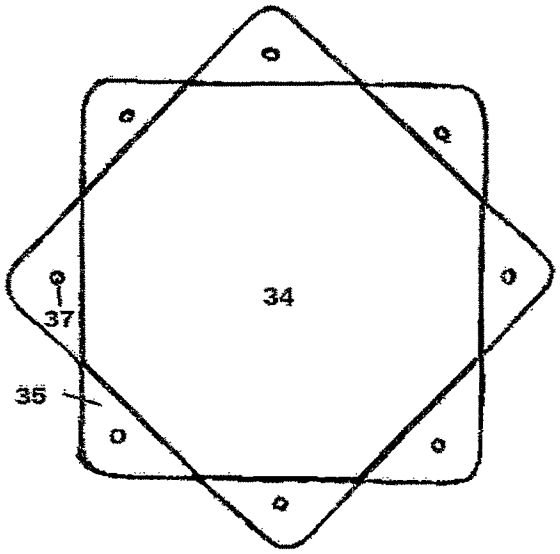
FIG. 18 is a top elevation view of the octagonal connection/positioning system of FIG. 17 with permanent nonadjustable air flow suction relief vents.
Figure 17:
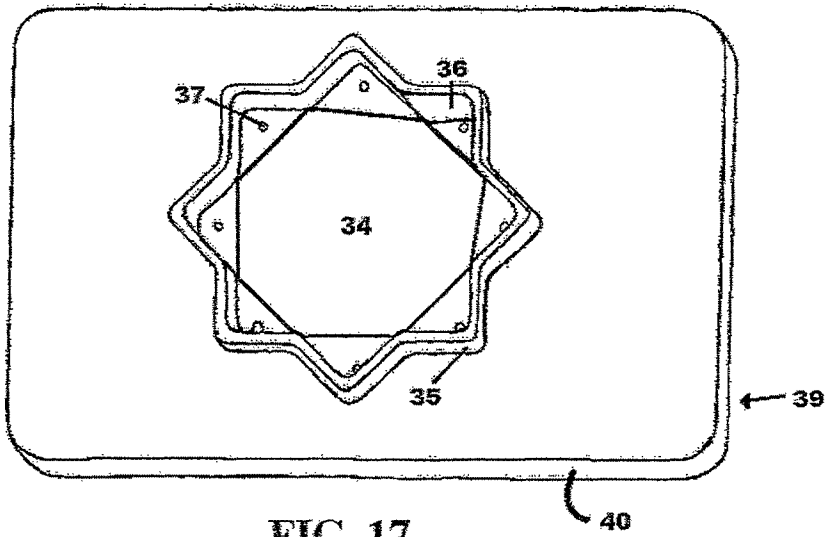
FIG. 17 is a top elevation view of the rectangular enclosure of FIGS. 15 and 16 that is reconfigurable and removable according to its octagonal connection/positioning system with permanent nonadjustable air flow suction relief vents.

Referring to FIGS. 12-14, the present invention may also include a separable two-piece 31 cleaning containment enclosure, homogenous triangular-shaped perimeter 32 with seal-creating base. Concave mortise-like edge and concave tenon-like joints temporarily bond and seal the two-piece 31 component into a one-piece unit. The cylindrical tube joiner 26 slides over the combined one-piece unit and is stopped by the bushing 33, which aids in the temporary bonding of the two-piece 31 cleaning containment enclosure. The dome-shaped lance acceptation tube port cap 28 with supportive hand grip 29 and homogenous diamond-shaped removable base also aid in the temporary bonding of the two-piece 31 cleaning containment enclosure. The combined one-piece unit may be continually separated and rejoined. Separation is permissible to facilitate the easy cleaning of dirt and debris that may become lodged in the uniform cylindrical suction chamber 25, and the cylindrical water pressure delivery lance acceptation tube port 9 during operation.

Referring to FIGS. 15-18, the present invention also includes a rectangular cleaning enclosure 39 with an outer wall structure 40, inner wall structure, and an octagonal enclosure 34 that also has an outer wall structure 35 and an inner wall structure 36. The octagonal enclosure 34 also incorporates permanent nonadjustable air flow suction relief vents 37 that provide adequate relief of the greater vacuum force during operation in such a way to facilitate consistent operation of the combined macro cleaning head.

The homogenous diamond-shaped perimeter 5 and/or the homogenous diamond-shaped removable base may be inserted in eight different directions into the octagonal enclosure 34. In particular, the homogenous diamond-shaped perimeter 5 may be removable from the octagonal enclosure 34 and may be repositionable at different positions relative to the octagonal enclosure 34. Each of the eight different configurations alters the alignment of the rectangular cleaning enclosure when referencing a specific point on the diamond-shaped perimeter 5 and/or homogenous diamond-shaped removable base.

Four permanent nonadjustable air flow suction relief vents 3 on the octagonal enclosure 34 will be exposed to the outer wall structure 1 of the homogenous diamond-shaped perimeter 5 and/or homogenous diamond-shaped removable base. Also, four permanent nonadjustable air flow suction relief vents 37 on the octagonal enclosure 34 will be exposed to the inner wall structure 2 of the homogenous diamond-shaped perimeter 5 and/or homogenous diamond-shaped removable base when combined with the rectangular cleaning enclosure 39.

The joining of the homogenous diamond-shaped perimeter 5 and/or homogenous diamond-shaped removable base and/or rectangular cleaning enclosure 39 reconfigures the elongated water pressure delivery lance 11 a greater distance away from the intended surface to be cleaned, which creates a versatile macro cleaning head.

A method of cleaning a surface with the above-described apparatus is also contemplated. An individual may use a multi-function surface cleaning apparatus as described hereinabove to clean away grout, debris, or any other objects from the cleaning surface. The individual positions a corner of the cleaning containment enclosure along a reference line 22 on the desired surface. Often this reference line 22 will be a grout line in between tiles on a floor surface, but additional reference lines are contemplated. A partial or complete seal is established between the cleaning containment enclosure and the cleaning surface. Pressure is applied to the gun trigger 18, thereby applying water pressure to the reference line 22 on the cleaning surface via the water pressure delivery lance 11. Suction pressure is also supplied to the reference line 22 on the cleaning surface by using the vacuum suction hose 7. The multi-function surface cleaning apparatus is moved along the reference line to maintain a straight line of transportation, allowing the multi-function surface cleaning apparatus to clean off grout and debris from the cleaning surface and to remove the displaced grout and debris using the vacuum suction hose 7.

The multi-function surface cleaning apparatus can also be moved in a lateral direction to the reference line 22 on the cleaning surface. This movement of the multi-function surface cleaning apparatus allows the individual to clean a perpendicular reference line, such as the grout line of an adjacent tile on the cleaning surface. Additionally, the multi-function surface cleaning apparatus can be rotated about a longitudinal axis. The individual may also rotate the stationary handle of the multi-function surface cleaning apparatus about the longitudinal axis of the multi-function surface cleaning apparatus via the wet-vacuum hose position control ring 16, which allows the individual to re-position oneself to direct the multi-function surface cleaning apparatus in a new direction. This allows the individual to move the multi-function surface cleaning apparatus down a new reference line without breaking the seal formed between the cleaning containment enclosure and the cleaning surface. The individual can rotate the multi-function surface cleaning apparatus and/or stationary handle up to 360 degrees, allowing for a full rotation of the multi-function surface cleaning apparatus to allow the individual to direct the apparatus along any desired reference line.

While several embodiments of a multi-function surface cleaning apparatus in accordance with the present invention are shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A multi-function surface cleaning apparatus, comprising:

a cleaning containment enclosure including a top surface and a plurality of walls connected to form a chamber therebetween, wherein each wall has an inner surface, an outer surface, and a bottom surface configured to form a seal between the cleaning containment enclosure and a cleaning surface, a water pressure delivery lance defining a passageway therethrough and fluidly connected with the chamber of the cleaning containment enclosure, the water pressure delivery lance removably connected to the cleaning containment enclosure such that the water pressure delivery lance is separately operable as a pressure washing gun from the cleaning containment enclosure, a vacuum suction hose defining a passageway therethrough and fluidly connected with the chamber of the cleaning containment enclosure, a delivery member port defining a passageway therethrough and configured to fluidly connect the water pressure delivery lance with the chamber of the cleaning containment enclosure, a suction port defining a passageway therethrough and configured to fluidly connect the vacuum suction hose with the chamber of the cleaning containment enclosure, an actuating member fluidly connected to an end of the water pressure delivery lance, wherein the actuating member is configured to control flow of fluid through the water pressure delivery lance, and a stationary handle mounted on the water pressure delivery lance, the stationary handle provided separate from the actuating member, the stationary handle comprising a control ring that holds the vacuum suction hose, wherein the suction port and the delivery member port are formed together to define an opening before connecting to the cleaning containment enclosure.

2. The multi-function surface cleaning apparatus as claimed in claim 1, wherein the plurality of walls is configured to form a diamond-shaped cleaning containment enclosure.

3. The multi-function surface cleaning apparatus as claimed in claim 2, wherein at least one of the plurality of walls defines a relief vent that extends from the inner surface of the wall of the cleaning containment enclosure therethrough to the outer surface of the wall of the cleaning containment enclosure.

4. The multi-function surface cleaning apparatus as claimed in claim 3, further comprising a locking groove system provided on the delivery member port.

5. The multi-function surface cleaning apparatus as claimed in claim 4, further comprising a stationary handle connected to the vacuum suction hose via a hose position ring.

6. The multi-function surface cleaning apparatus as claimed in claim 5, further comprising a burn preventative molding positioned around a circumferential surface of the water pressure delivery lance.

7. The multi-function surface cleaning apparatus as claimed in claim 6, wherein the actuating member is a gun trigger including a quick connector configured to receive a water pressure line.

8. A multi-function surface cleaning apparatus, comprising:

a diamond-shaped cleaning containment enclosure including a top surface and a plurality of walls connected to form a chamber therebetween, wherein each wall has an inner surface, an outer surface, and a bottom surface configured to form a seal between the cleaning containment enclosure and a cleaning surface, a delivery member defining a passageway therethrough and fluidly connected with the chamber of the cleaning containment enclosure, a vacuum suction hose defining a passageway therethrough and fluidly connected with the chamber of the cleaning containment enclosure, an actuating member fluidly connected to an end of the delivery member, wherein the actuating member is configured to control flow of fluid through the delivery member, and an attachment member including a rectangular-shaped body defining a chamber therebetween and an octagonal-shaped enclosure connected to a top surface of the rectangular-shaped body;

wherein, the diamond-shaped cleaning containment enclosure is configured for insertion into the octagonal-shaped enclosure such that the diamond-shaped cleaning containment enclosure is removable from the octagonal-shaped enclosure and is repositionable at different mounting positions on the octagonal-shaped enclosure to change a direction in which the attachment member is moved.

9. The multi-function surface cleaning apparatus as claimed in claim 8, wherein, at least one of the plurality of walls defines a relief vent that extends from the inner surface of the wall of the diamond-shaped cleaning containment enclosure therethrough to the outer surface of the wall of the diamond-shaped cleaning containment enclosure, and the octagonal-shaped enclosure further defines at least one relief vent that extends from an inner surface of the octagonal-shaped enclosure therethrough to an outer surface of the octagonal-shaped enclosure.

10. The multi-function surface cleaning apparatus as claimed in claim 9, wherein the delivery member is fluidly connected with the chamber of the cleaning containment enclosure using spring-loaded buttons positioned on an outer surface of a delivery member port that extends from the top surface of the cleaning containment enclosure, and the vacuum suction hose is fluidly connected with the chamber of the cleaning containment enclosure via a suction port defining a passageway therethrough;

wherein the delivery member port defines a passageway therethrough;

the spring-loaded buttons are biased in an outward direction from the outer surface of the delivery member port and extend through corresponding holes extending through a delivery member cap positioned on an end of the delivery member; and the suction port is integrally joined with the delivery member port.

11. The multi-function surface cleaning apparatus as claimed in claim 10, further comprising a stationary handle connected to the vacuum suction hose via a hose position ring.

12. The multi-function surface cleaning apparatus as claimed in claim 11, further comprising a burn preventative molding positioned around a circumferential surface of the delivery member.

13. The multi-function surface cleaning apparatus as claimed in claim 12, wherein the actuating member is a gun trigger including a quick connector configured to receive a water pressure line.

14. The multi-function surface cleaning apparatus as claimed in claim 13, wherein the diamond-shaped cleaning containment enclosure is comprised of two corresponding parts, wherein the two corresponding parts are connected together via a joining member configured to slide over the suction port upon the corresponding parts being positioned together.

* * * * *